US008356441B2

(12) United States Patent
Meinel

(10) Patent No.: US 8,356,441 B2
(45) Date of Patent: Jan. 22, 2013

(54) RAPID PISTOL MAGAZINE LOADER

(75) Inventor: Edward Steele Meinel, Reston, VA (US)

(73) Assignee: GemOptics LLC, Reston, VA (US)

( * ) Notice: Subject to any disclaimer, the term of this patent is extended or adjusted under 35 U.S.C. 154(b) by 184 days.

(21) Appl. No.: 12/686,629

(22) Filed: Jan. 13, 2010

(65) Prior Publication Data

US 2010/0175294 A1 Jul. 15, 2010

Related U.S. Application Data

(60) Provisional application No. 61/144,527, filed on Jan. 14, 2009, provisional application No. 61/162,519, filed on Mar. 23, 2009.

(51) Int. Cl.
*F41A 9/61* (2006.01)

(52) U.S. Cl. ..... 42/88; 42/87

(58) Field of Classification Search ..... 42/87, 88, 42/89

See application file for complete search history.

(56) References Cited

U.S. PATENT DOCUMENTS 2,394,033 A * 2/1946 Wossum ..... 86/47
4,719,715 A 1/1988 Howard
4,949,495 A * 8/1990 Mari ..... 42/87
D348,503 S 7/1994 Claveau
5,417,003 A 5/1995 Claveau
6,189,254 B1 2/2001 Steitz
6,810,616 B2 * 11/2004 Tal et al. ..... 42/87
7,257,919 B1 8/2007 Farley
7,383,657 B2 6/2008 Pikielny
7,503,138 B2 3/2009 Tal et al.
7,568,421 B2 * 8/2009 Cummings ..... 89/33.2
7,637,048 B2 12/2009 Tal et al.

OTHER PUBLICATIONS

HKS Magazine Speedloaders, Jan. 6, 2012.
UpLULA Universal Semi-Auto Pistol Magazine Loader, Jan. 6, 2012.
LDR 01—Pistol Magazine Loader 9mm & .40 S&W, Jan. 6, 2012.
ADCO "Super Thumb" Magazine Loading Tool, Jan. 6, 2012.

* cited by examiner

*Primary Examiner* — Daniel Troy
(74) *Attorney, Agent, or Firm* — Duane S. Kobayashi

(57) ABSTRACT

A pistol magazine loader device. The pistol magazine loader device includes a housing designed to receive a magazine. A control element, whose movement is directed by a handle device, coordinates the movement of a plunger designed to push a magazine follower or first cartridge resident at a top of the magazine down into the magazine and a cartridge pusher that pushes a second cartridge into the magazine.

15 Claims, 26 Drawing Sheets

RAPID PISTOL MAGAZINE LOADER

This application claims priority to provisional application No. 61/144,527, filed Jan. 14, 2009, and provisional application No. 61/162,519, filed Mar. 23, 2009. Each of the above-identified applications are incorporated by reference herein, in its entirety, for all purposes.

BACKGROUND

1. Field of the Invention

The present invention relates generally to magazine loaders and, more particularly, to a rapid pistol magazine loader device.

2. Introduction

Ammunition is fed into a firing chamber via a removable magazine holding multiple rounds of ammunition. Ammunition is typically loaded into the magazine manually by hand. This entirely manual loading process can be a tedious operation. In one example, a tool can be used in combination with a hard surface to push an existing cartridge down into the magazine. The user would then manually insert a cartridge into the top of the magazine. In another example, manufacturers have designed tools that load a magazine by pushing ammunition cartridges into the magazine via a downward-loading motion. What is needed is an efficient magazine loading mechanism.

SUMMARY

A rapid pistol magazine loader, substantially as shown in and/or described in connection with at least one of the figures, as set forth more completely in the claims.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

As noted, manual insertion of cartridges into a magazine is tedious and time consuming. In accordance with the present invention, a rapid magazine loader device is provided that obviates the need for manual insertion of cartridges in the magazine.

Figure 1A:
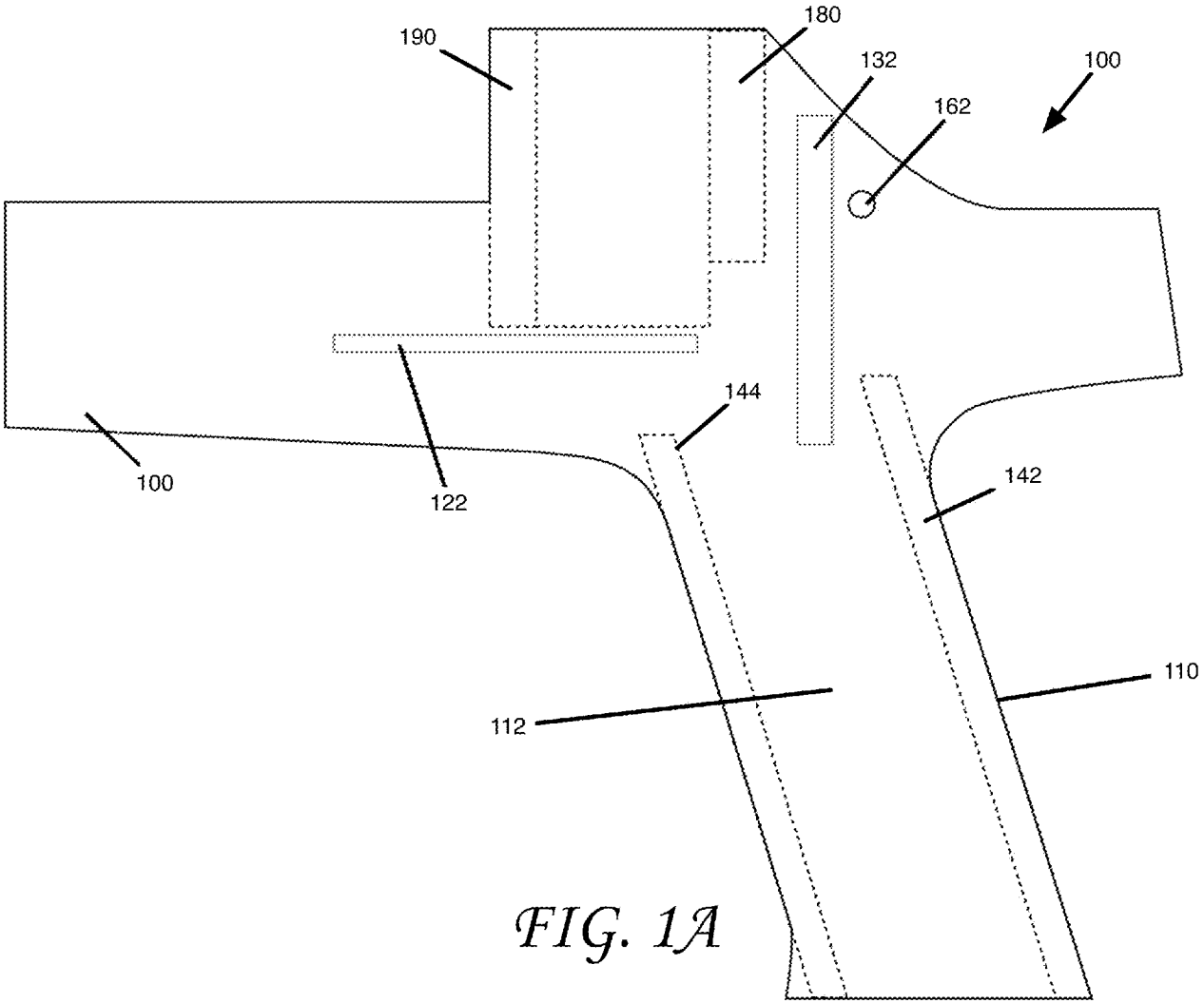
FIGS. 1A-1D illustrates an embodiment of a magazine loading device.
Figure 1B:
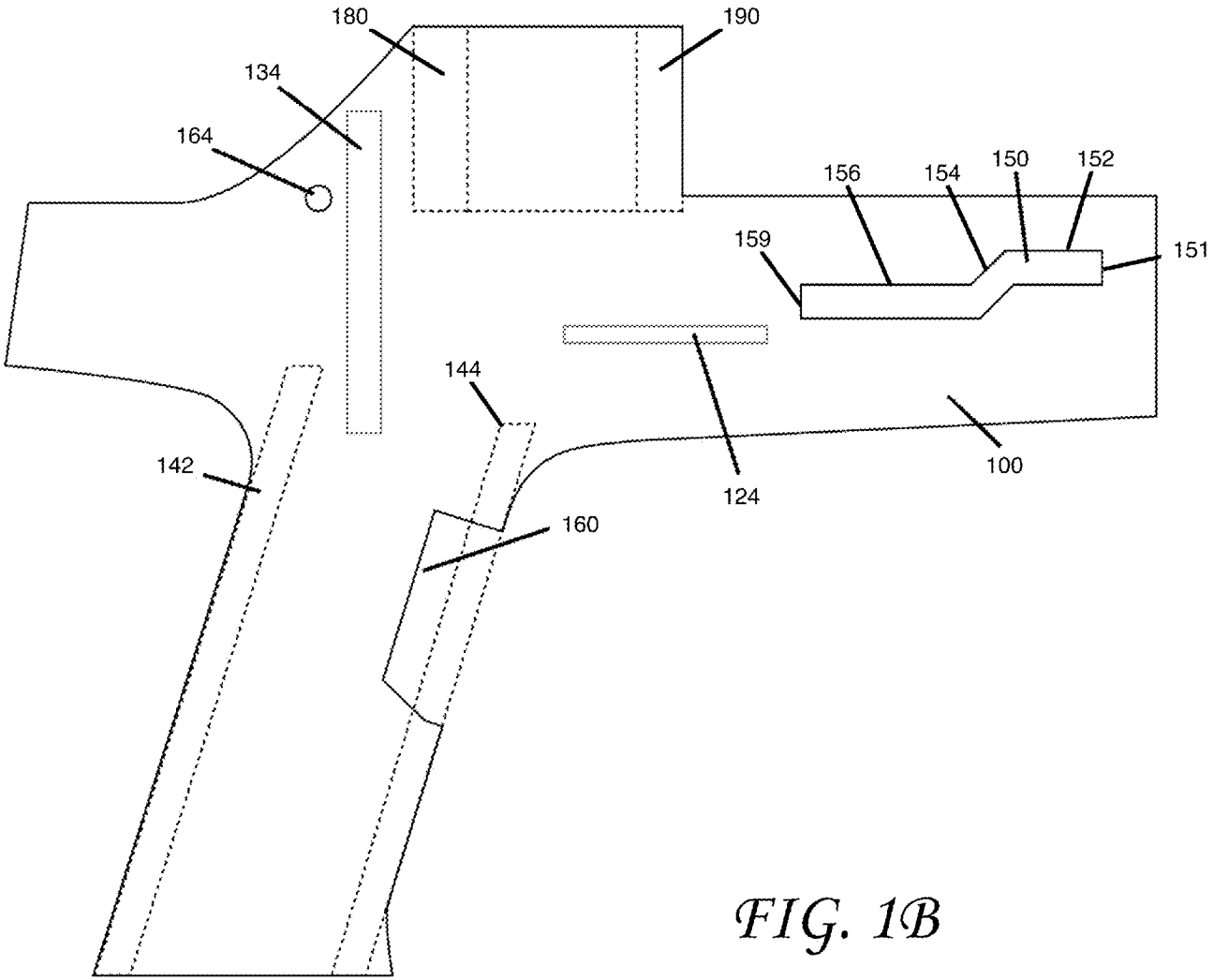
Figure 8:
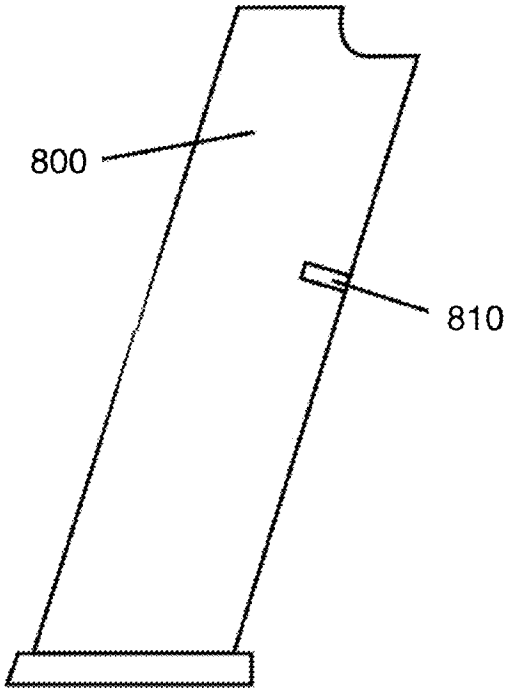
FIG. 8 illustrates an embodiment of a magazine.

FIGS. 1A and 1B illustrate views of a first and second side of a pistol magazine loader device 100 according to the present invention. The pistol magazine loader device 100 includes a grip 110, which can be held in the hand much like a user would hold a pistol. The grip 110 has a magazine well 112 formed by the first and second sides and magazine well guides 142 and 144. The magazine well 112 is designed to receive a magazine 800 (see FIG. 8) to be loaded with cartridges.

Figure 3:
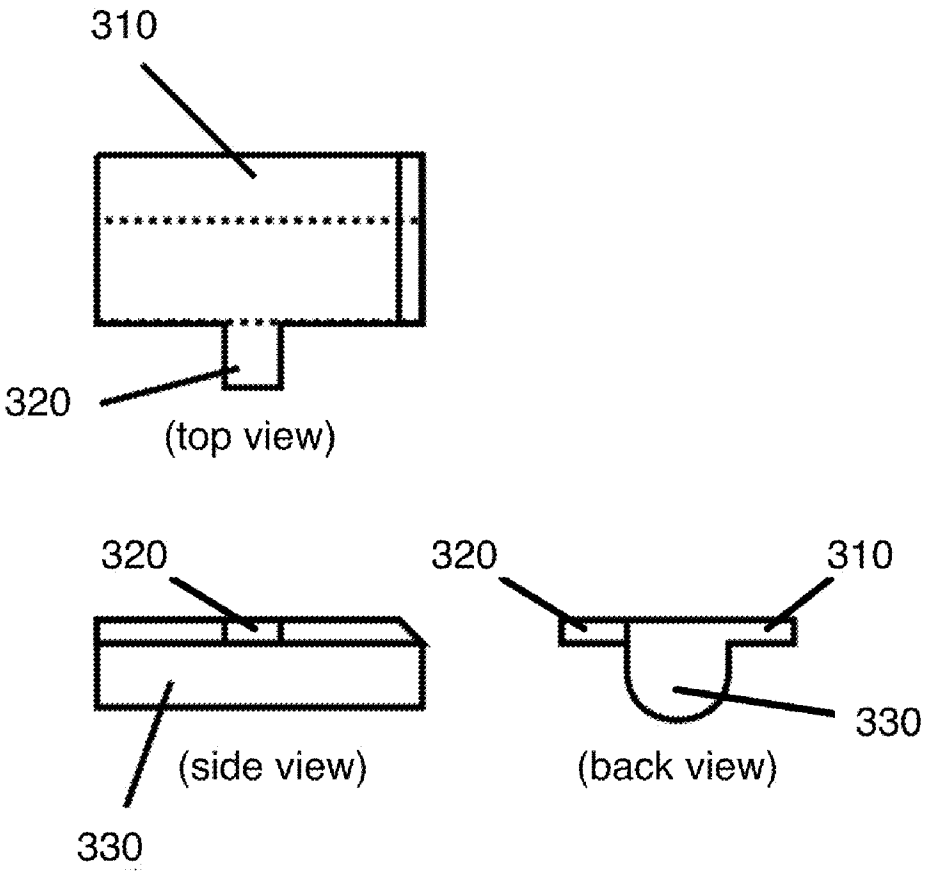
FIG. 3 illustrates an embodiment of a cartridge pusher.

In one embodiment, the first and second sides of the pistol magazine loader device 100 differ slightly. The first side of the pistol magazine loader device 100 (FIG. 1A) includes a slot 122 that guides a wing 310 of a cartridge pusher 300 (see FIG. 3). The second side of the pistol magazine loader device 100 (FIG. 1B) includes a corresponding slot 124 that guides a tab 320 of the cartridge pusher 300. In combination, the slot 122 and the slot 124 enable the wing 310 and the tab 320, respectively, to slide along a path defined by the slots 122 and 124. As will be described in greater detail below, this movement of the wing 310 and the tab 320 along the path defined by the slots 122 and 124 enables an end of a pusher portion 330 of a cartridge pusher 300 to move into contact with a cartridge and to push the cartridge into the magazine 800 that has been inserted into the magazine well 112. In one embodiment, the pusher portion 330 of the cartridge pusher 300 is designed to make contact with a tip of a cartridge to provide movement substantially in a direction defined by a centerline axis of the cartridge being pushed. As would be appreciated, various other mechanisms can be used by a cartridge pusher to produce such movement. For example, a ring or other contoured template can be designed to contact a front end of a cartridge.

As FIGS. 1A and 1B further illustrate, the first and second sides also include slots 132 and 134, respectively. Slots 132 and 134 are designed to guide the motion of a plunger 200 (see FIG. 2). As illustrated, plunger 200 includes a first tab 222 and a second tab 224 that are designed for slidable engagement in slots 132 and 134. In this slidable engagement, movement of the tabs 222 and 224 in the slots 132 and 134 produce a raising and lowering motion of plunger portion 210. As will be described in greater detail below, the plunger portion 210 is designed to contact a magazine follower or a cartridge in the top-most position of the magazine 800 and to push the magazine follower or the cartridge in the top-most position of the magazine 800 down into the magazine 800, thereby creating a space for a cartridge to be pushed into the magazine 800 at an angle substantially defined by a centerline axis of the cartridge being pushed.

Figure 2:
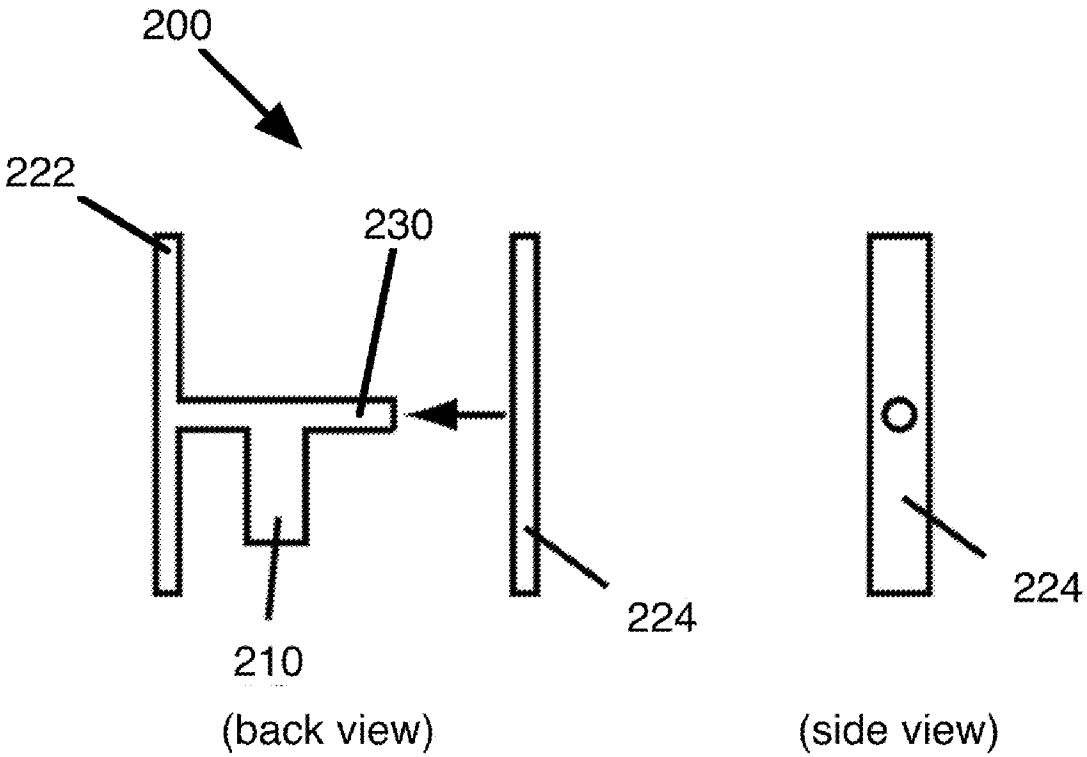
FIG. 2 illustrates an embodiment of a plunger.

In the illustrated embodiment of the plunger 200 in FIG. 2, the plunger 200 is formed by the coupling of the tab 224 onto a rod portion 230 of a single plunger piece that includes the tab 222 and plunger portion 210. This assembly enables slidable engagement of rod portion 230 of plunger 200 with a guide slot in the control element 400 (see FIG. 4) that directs movement of the plunger 200. In one embodiment, the plunger portion 210 is designed to contact a cartridge in a single point or area. In another embodiment, the plunger portion 210 is designed to contact a cartridge in a plurality of points or areas.

Figure 1C:
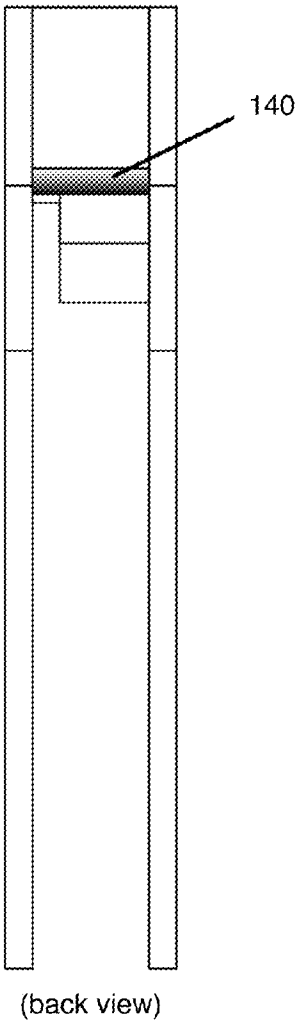
Figure 1D:
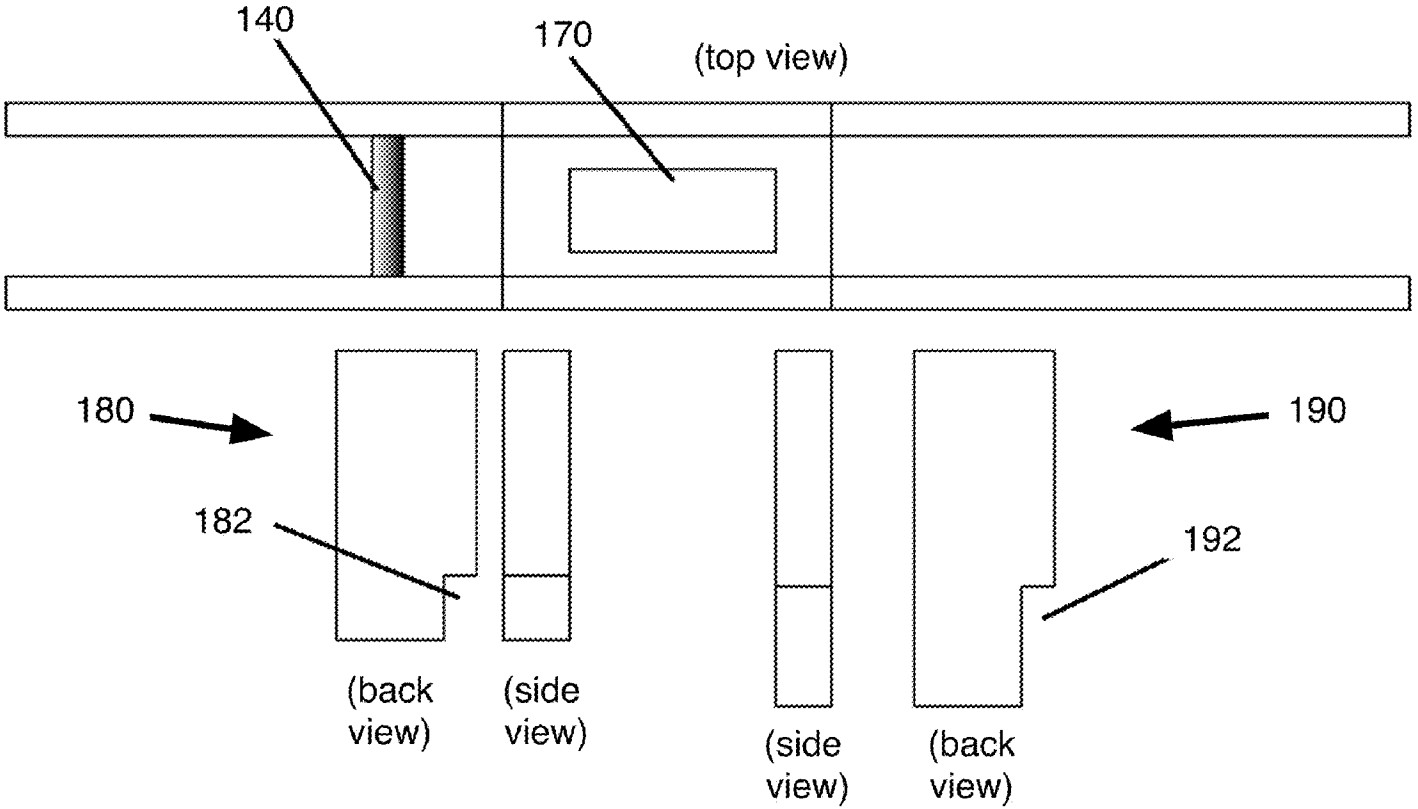

Also illustrated in FIGS. 1A and 1B are holes 162 and 164 formed in the first and second sides that are designed to receive first and second ends of a pin 140 (see back view of FIG. 1C and top view of FIG. 1D). As will be described in greater detail below, the pin 140 and the magazine well guide 142 serve to constrain the vertical motion of the control element 400.

Figure 6:
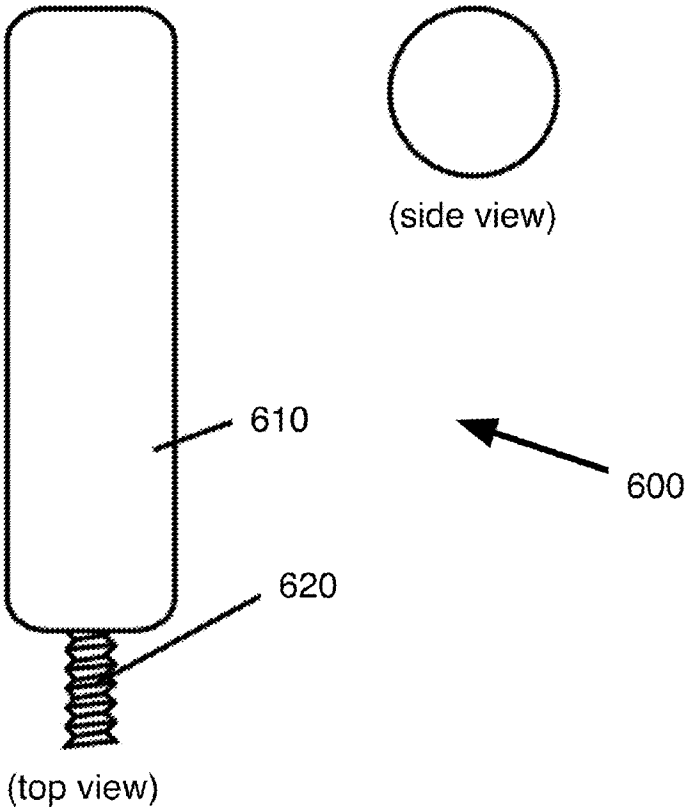
FIG. 6 illustrates an embodiment of a handle.

Also illustrated in FIG. 1B is a slot 150 formed in the second side of the pistol magazine loader device 100 that guides movement of a handle 600 (see FIG. 6). In one embodiment, the handle 600 includes a handle portion 610 and a coupling portion 620. The coupling portion 620 enables attachment of the handle 600 to the control element 400.

Figure 7:
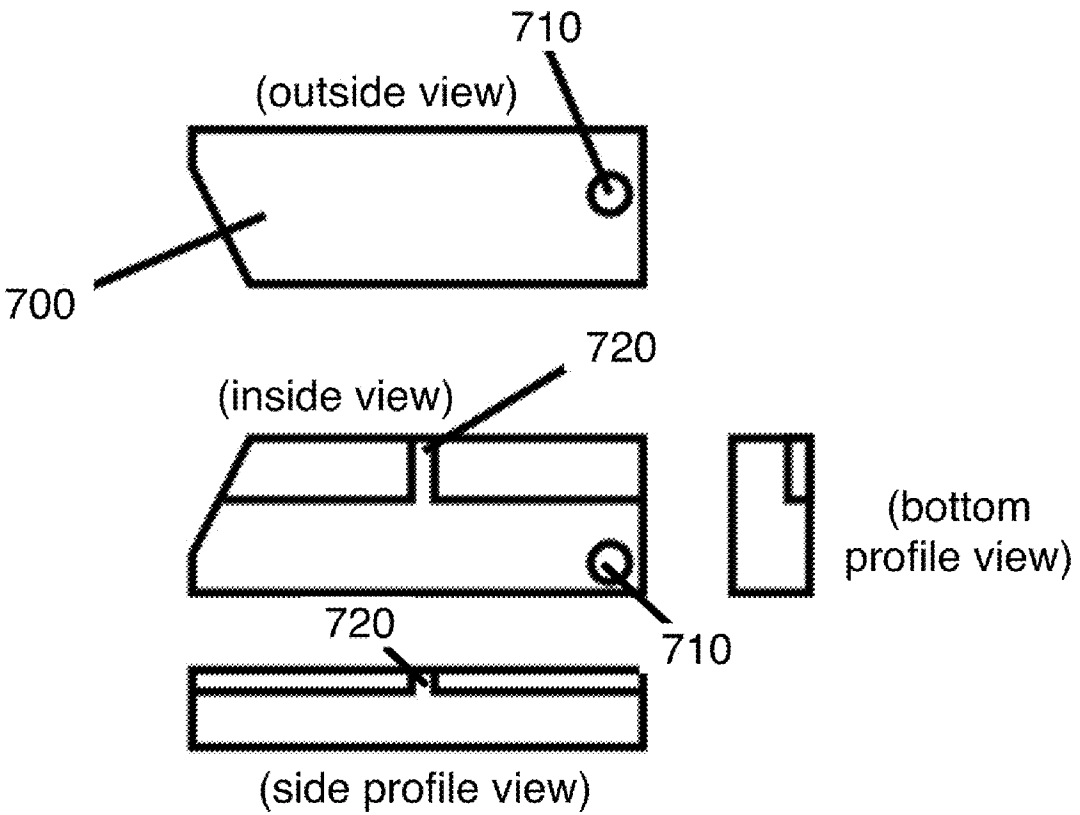
FIG. 7 illustrates an embodiment of a magazine lock.

Also illustrated in FIG. 1B is a notch 160 that provides space for the magazine lock 700 (see FIG. 7). The magazine lock 700 includes a hole 710 formed in the magazine lock 700 that enables magazine lock 700 to be coupled to the second side of the pistol magazine loader device 100. The magazine lock 700 also includes a ridge 720 that engages the notch 810 formed in the magazine 800, thereby securing the magazine 800 in the magazine well 112 during loading of the magazine 800.

The loading of cartridges into the magazine 800 is facilitated by the control element 400 (see FIG. 4), which is designed to translate the movement of the handle 600 into coordinated movement of the plunger 200 and the cartridge pusher 300. In one embodiment, the control element 400 is in the form of a slider mechanism.

As illustrated, the control element 400 includes a hole 410 formed in a front end of the control element 400. The hole 410 is designed to receive the coupling portion 620 of the handle 600. In one embodiment, the coupling portion 620 includes a threaded portion that screws into the corresponding threads formed in the wall of hole 410. As would be appreciated, various methods by which handle 600 can be permanently or removably coupled to the control element 400 can be used. In one embodiment, a portion of the coupling portion 620 that extends from the hole 410 is designed for slidable engagement with the slot 150 formed in the second side of the pistol magazine loader device 100 (see FIG. 1B).

The slidable engagement of the coupling portion 620 with the slot 150 produces horizontal and/or vertical movement of the control element 400 as the user directs the handle 600 along a path guided by the slot 150. As noted above, the vertical movement of the rear portion of the control element 400 is constrained by the pin 140 and the magazine well guide 142.

Figure 4:
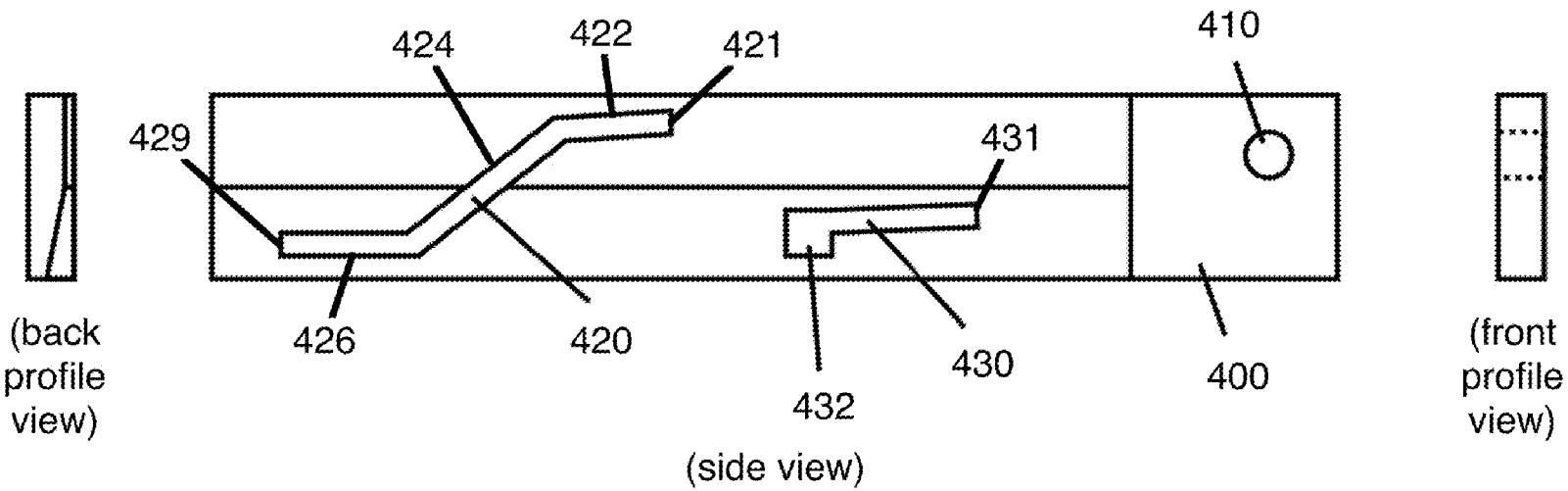
FIG. 4 illustrates an embodiment of a control element.

As FIG. 4 further illustrates, the control element 400 includes a slot 420 formed in the control element 400. The slot 420 is designed to be slidably engaged with the rod portion 230 of the plunger 200. In one embodiment, the slot 420 includes multiple contiguous slot segments 422, 424, 426. In general, one or more multiple contiguous slot segments can be designed to translate motion of the control element 400 into a corresponding motion in the plunger 200.

In one embodiment, the movement of the handle 600 forward would cause the rod portion 230 of the plunger 200 to move from a first end 421 of the slot 420 along the slot segment 422. This movement of the rod portion 230 along the slot segment 422 can be designed to retain the plunger 200 in a relatively fixed position above the magazine follower or cartridge in the top-most position of the magazine. The transition of the rod portion 230 from slot segment 422 to slot segment 424 can be designed to initiate the downward motion of the plunger 200. More specifically, the movement of the rod portion 230 along the slot segment 424 would cause the tabs 222, 224 to slide down the slots 132, 134, thereby lowering the plunger portion 210 to engage the magazine follower or the top-most cartridge in the magazine 800. The transition of the rod portion 230 from slot segment 424 to slot segment 426 can be designed to retain the plunger portion 210 at a depressed position in the magazine 800 until the rod portion 230 reaches a second end 429 of the slot 420. As will be described in greater detail below, the timing of the movement of the rod portion 230 forward and back through the slot segment 424 is designed to coincide with the simultaneous control of the cartridge pusher 300 by the control element 400.

The cartridge pusher 300 is coupled to the control element 400 through the slidable engagement of the tab 320 of the cartridge pusher 300 along the slot 430 formed in the control element 400. As illustrated, a notch 432 is further formed on one end of the slot 430. As will be described in greater detail below, the notch 432/slot 430 combination acts as a delay circuit for the cartridge pusher 300 in synchronizing the movement of the cartridge pusher 300 relative to the movement of the plunger 200.

Figure 5:
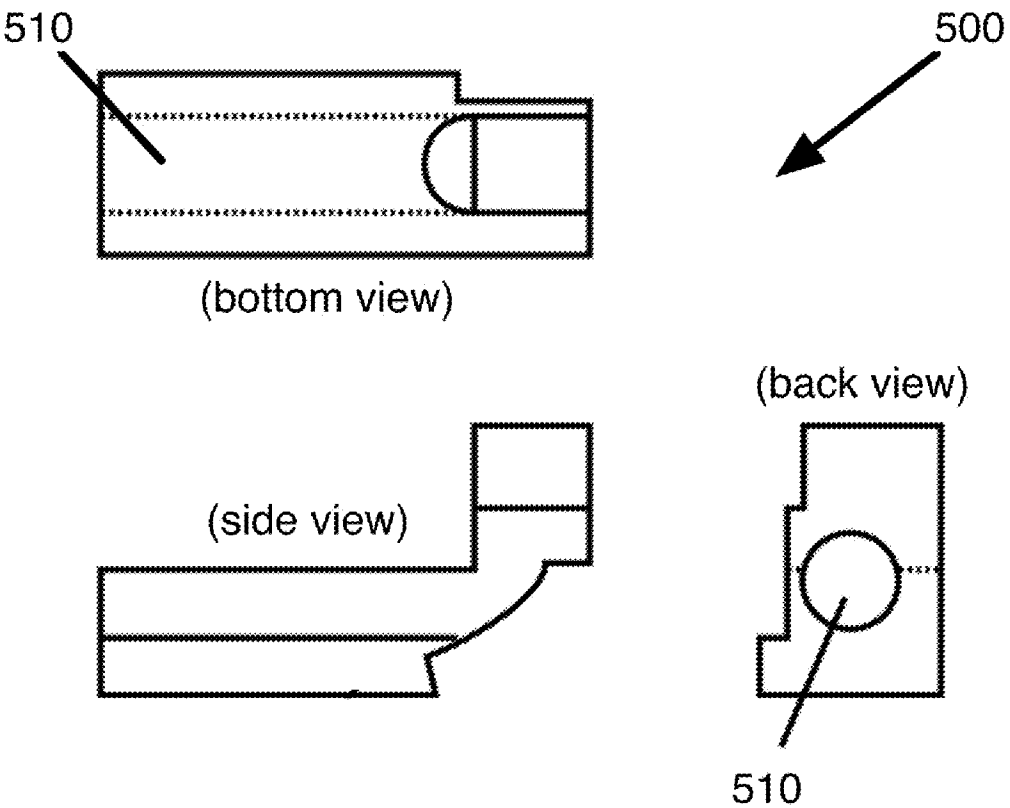
FIG. 5 illustrates an embodiment of a cartridge tray.

The cartridge pusher 300 is designed to fit into a channel 510 formed in the cartridge tray 500 (see FIG. 5). The channel 510 formed in the cartridge tray 500 operates as a guide for feeding cartridges into the magazine 800.

Cartridges are loaded into the channel 510 in the cartridge tray 500 via a well 170 formed in the top of the pistol magazine loader device 100. Multiple cartridges can be loaded into the well 170 for individual feeding of cartridges into the magazine 800. The well 170 which is formed using the first and second sides of the pistol magazine loader device 100 and the well wall sides 180 and 190. The well wall sides 180 and 190 have notches 182, 192, respectively, formed therein to provide clearance for the operation of the control element 400.

Having described an embodiment of a structure of the pistol magazine loader device 100, reference is now made to FIGS. 9A-9F, which illustrate the operation of the pistol magazine loader device 100. Starting with FIG. 9A, the magazine 800 is inserted into the magazine well 112 formed in the grip 110 of the pistol magazine loader device 100 much like a magazine would be inserted into a pistol. The magazine lock 700 is rotated in toward the grip 110 so that the ridge 720 engages in the notch 810 of the magazine 800, thereby locking the magazine 800 into place. The ammunition cartridges 900 are then inserted into the well 170 formed in the top of the pistol magazine loader device 100.

Note that at this point, the control element 400 is in the rear-most position within the pistol magazine loader device 100. In this rear-most position, the coupling portion 620 of the handle 600 (not shown) is in the rear-most position of slot 150. Also, the rod portion 230 of the plunger 200 is engaged in substantially the end 421 of the slot 420 formed in the control element 400. In this position, the plunger 200 is in a raised position relative to the magazine 800. Additionally, the tab 320 of the cartridge pusher 300 is located at a front end 431 of the slot 430 formed in the control element 400. In this position, the cartridge pusher 300 is located above the cartridge tray 500 such that the cartridge 900 in the lowest position in the well 170 sits on the top of the cartridge pusher 300.

Figure 9A:
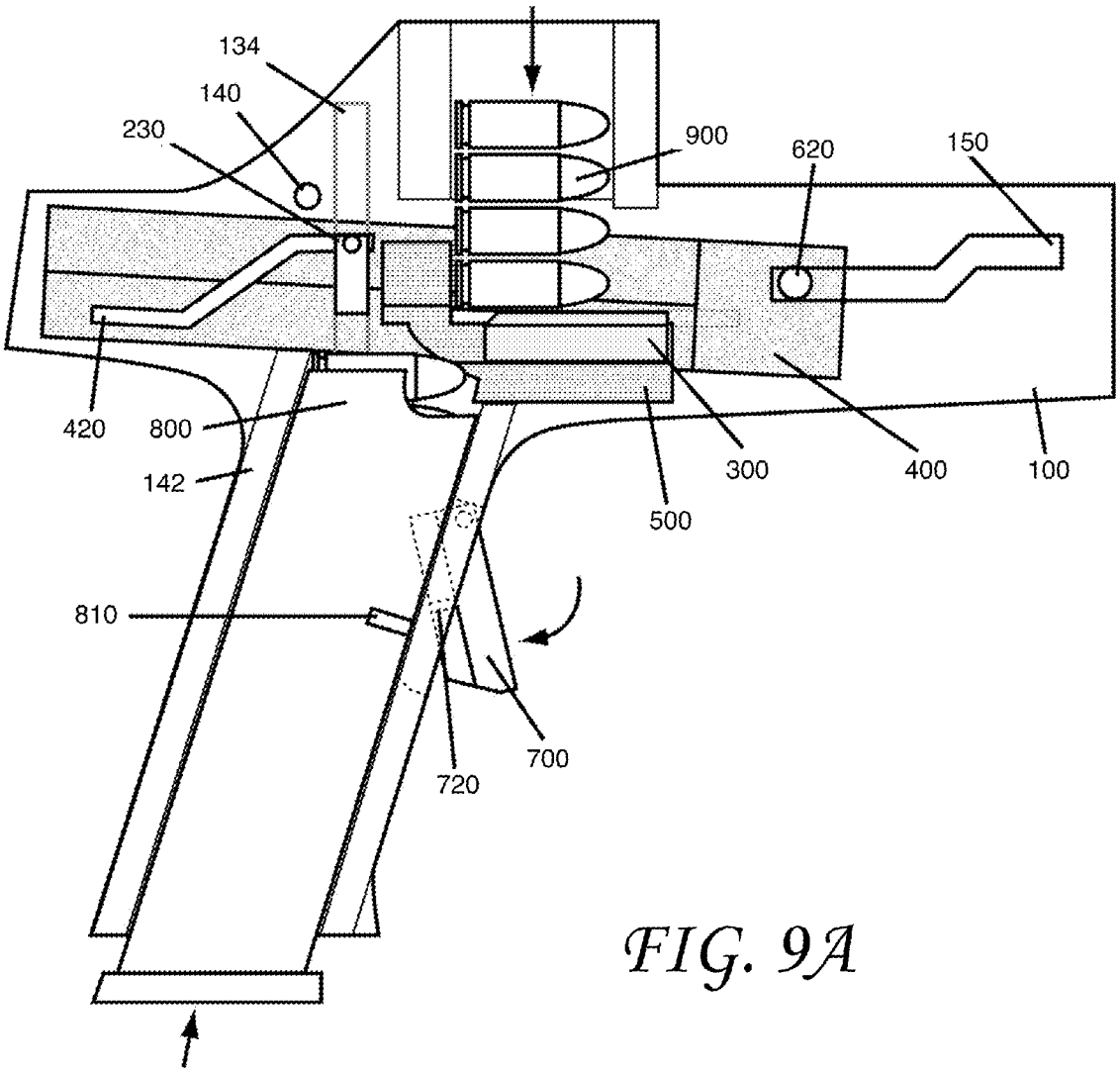
FIGS. 9A-9F illustrate an operation of a magazine loading device.
Figure 9B:
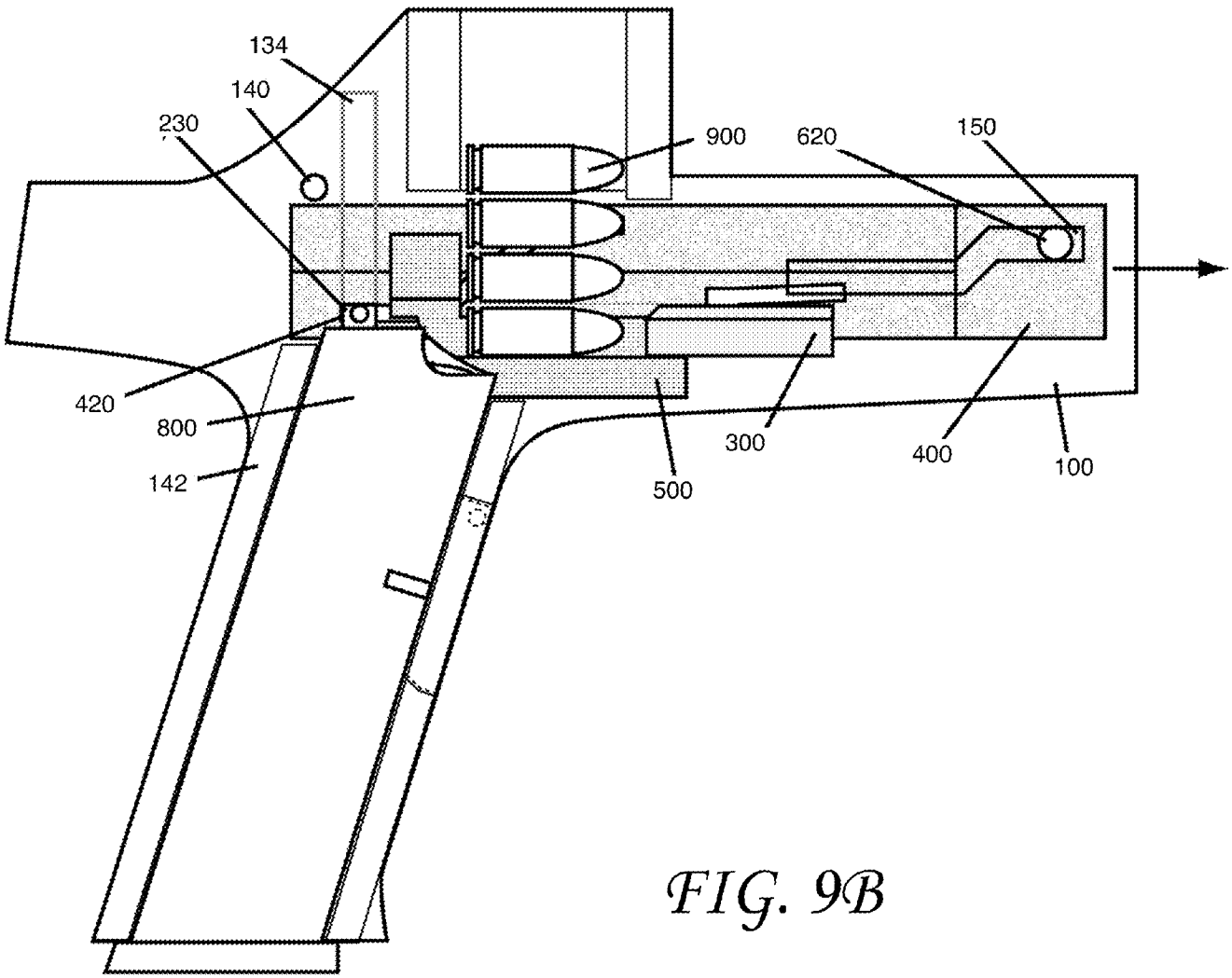

Referring to FIG. 9B, the handle 600 is pushed forward causing the control element 400 to also move forward. The forward movement of the control element 400 causes the rod portion 230 of the plunger 200 to move to the end 429 of the slot 420. The movement of the rod portion 230 through slot segment 424 of the slot 420 forces the plunger 200 downward, which functions to contact the top end of the cartridge in the top-most position of the magazine 800 further down into the magazine 800. The forward movement of the control element 400 also forces the tab 320 of the cartridge pusher 300 forward, thereby causing the cartridge pusher 300 to move forward. This forward movement of the cartridge pusher 300 allows the lowest-most cartridge in the well 170 to fall into the channel 510 of the cartridge tray 500. It should be noted that the movement of the coupling portion 620 of the handle 600 through slot segment 154 of the control element 400 also causes a change in angle of the control element 400 as the front end of the control element 400 tilts upward relative to its initial position in FIG. 9A. In this process, the pin 140 and the magazine well guide 142 constrain vertical movement of the control element 400, effectively allowing the control element 400 to pivot at that point. The change in angle of the control element 400 as it moves forward also causes the tab 320 of the cartridge pusher 300 to become engaged with the notch 432 of the slot 430 in the control element 400.

Figure 9C:
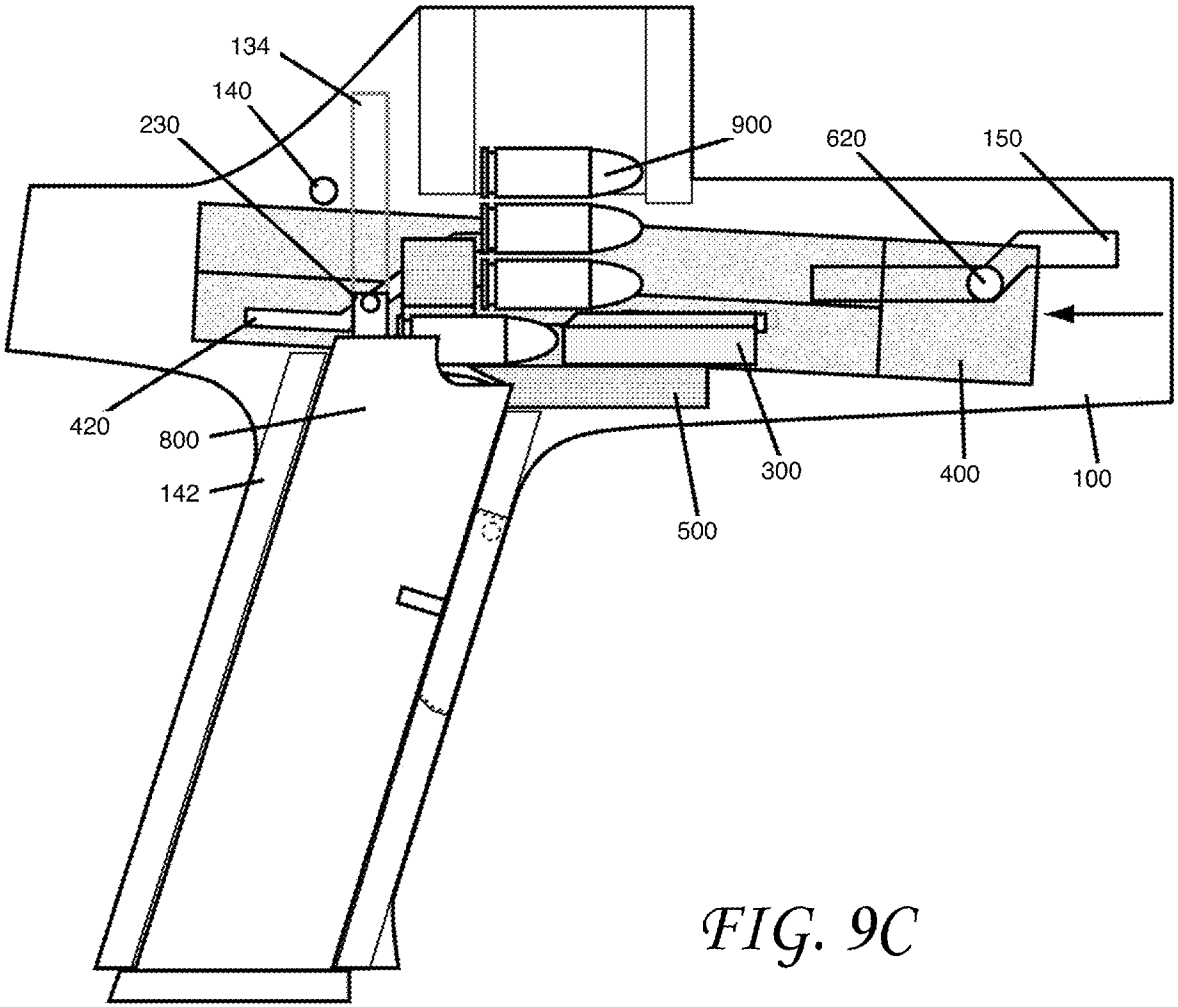

FIG. 9C illustrates the next step in the process where the cartridge resting in the channel 510 of the cartridge tray 500 is pushed into the top-most position of the magazine 800. Here, it should be noted that the plunger 200 has already pushed an existing cartridge in the magazine 800 further down into the magazine 800. As the handle 600 is pulled back, the control element 400 also moves back. In the distance that the coupling portion 620 of the handle 600 moves from the end 151 of the slot segment 152 to the beginning of the slot segment 154, the cartridge pusher 300 moves back and pushes the cartridge resting in the channel 510 part way into the top-most position of the magazine 800. The initial movement of the cartridge pusher 300 back ends when the passage of the coupling portion 620 of the handle 600 moves through the slot segment 154 of the slot 150. Movement of the coupling portion 620 through the slot segment 154 of the slot 150 causes a change in angle of the control element 400 as the front end of the control element 400 tilts downward. In this process, the tab 320 of the cartridge pusher 300 disengages from the notch 432 of the slot 430 in the control element 400. With this disengagement, further movement of the control element 400 back will not cause the cartridge pusher 300 to move further back until the tab 320 of the cartridge pusher reaches the end 431 of the slot 430 in the control element 430. The length of the slot 430 thereby creates a delay from the initial movement of the cartridge pusher 300 back until the final movement of the cartridge pusher 300 back. During this delay period, while the control element 400 continues to move back, the rod portion 230 of the plunger 200 traverses the slot segment 424 of the slot 420 in the control element 400. This traversal causes the plunger 200 to lift such that it will no longer impede the final movement back of the cartridge that is partially inserted into the magazine 800.

Figure 9D:
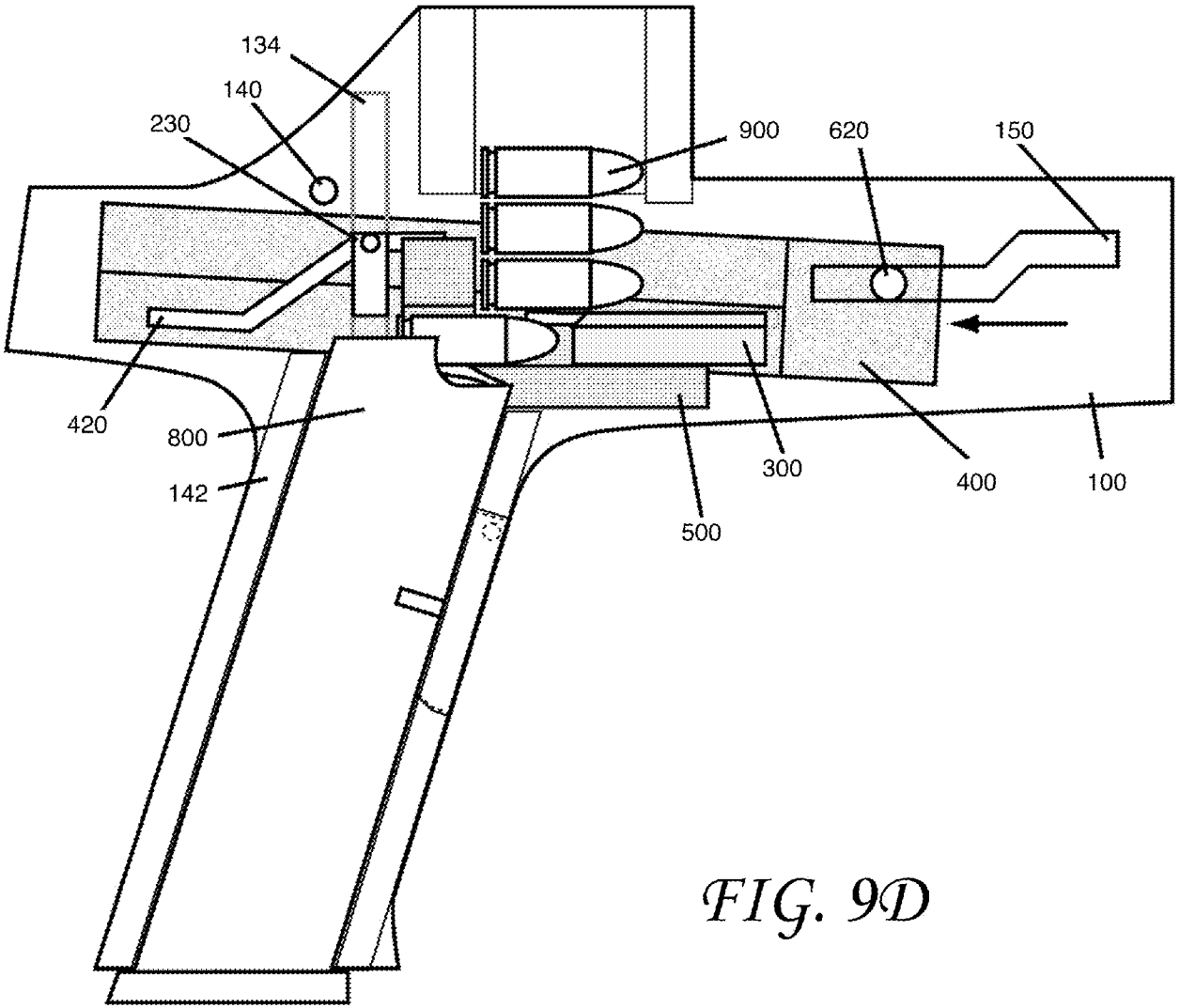
Figure 9E:
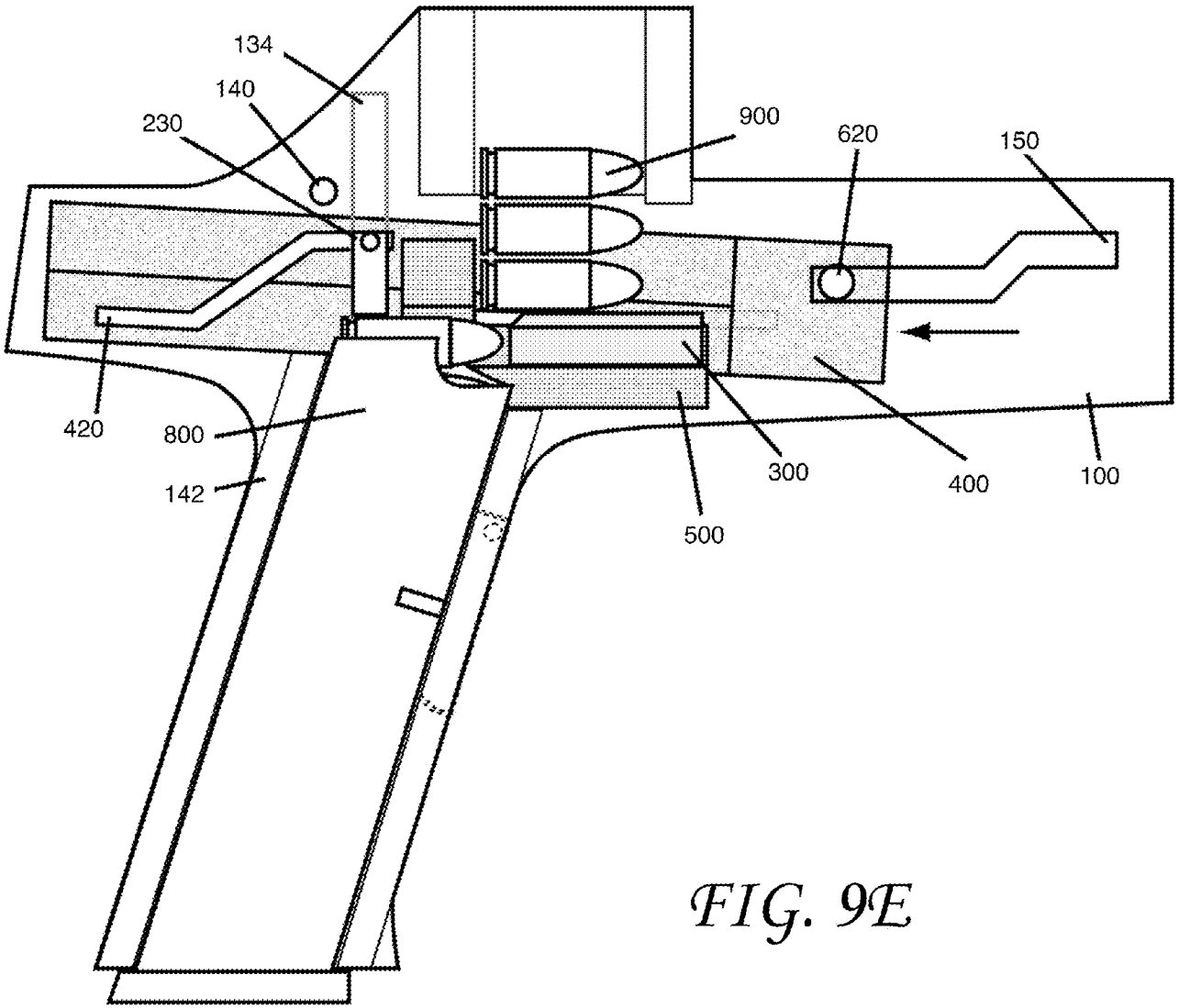
Figure 9F:
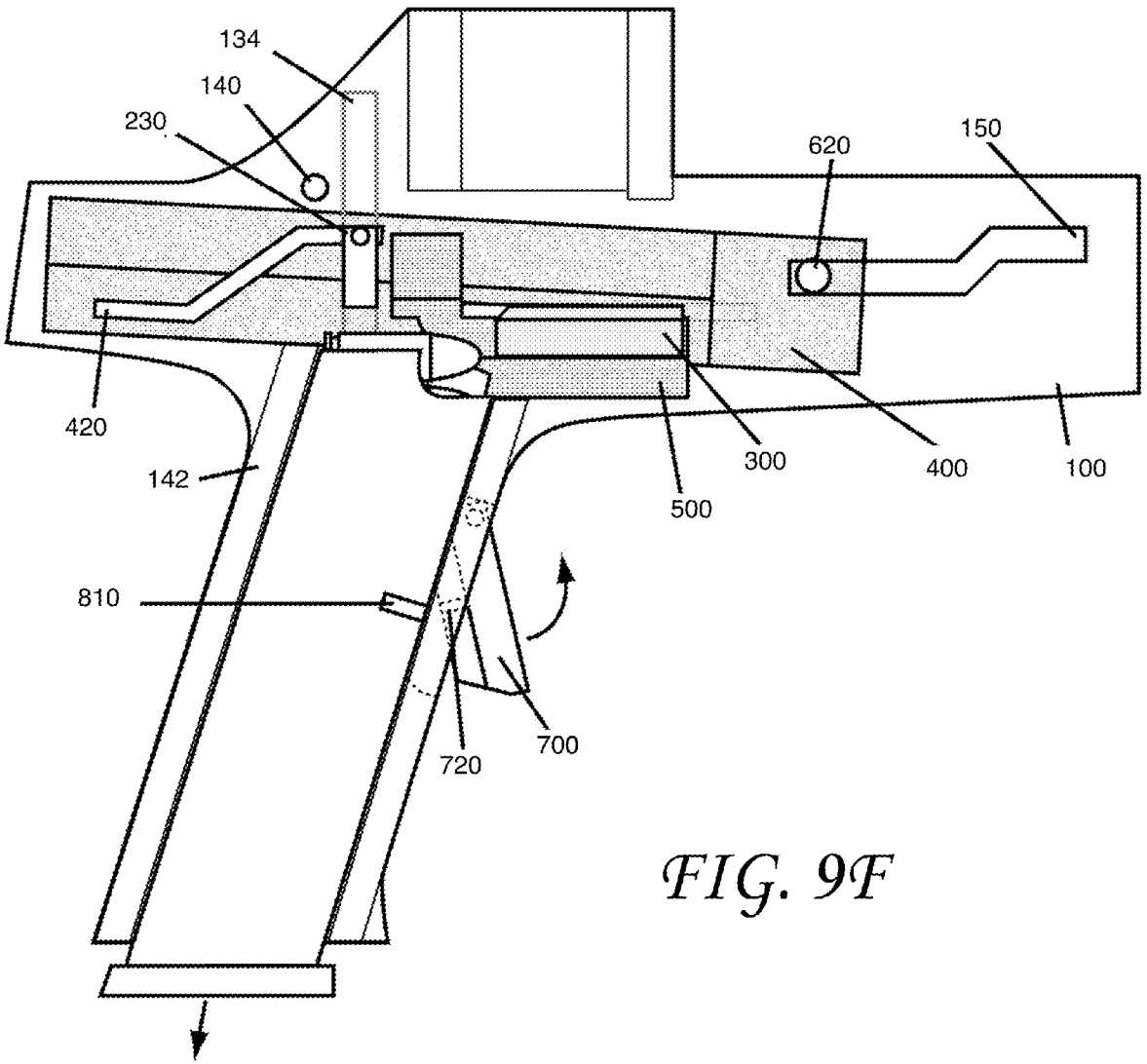

At or around the time that the plunger 200 has lifted and is now clear of the incoming cartridge, the tab 320 of the cartridge pusher 300 re-engages with the end 431 of the slot 430 in the control element 430 (see FIG. 9D). This re-engagement will cause the cartridge pusher 300 to resume movement back as the control element 400 moves back. The cartridge pusher 300 can then push the cartridge the rest of the way into the magazine 800 as the control element 400 continues to the rear-most position (see FIG. 9E).

The cycle illustrated by FIGS. 9A-9E is repeated until all of the cartridges inserted into the well 170 are loaded into the magazine 800. This cycle is accomplished by the user through the back and forth movement of the handle 600, while holding the grip 110. Rapid loading of the pistol magazine is thereby facilitated. Once all of the cartridges have been loaded, the magazine lock 700 is rotated away from the grip to release the magazine 800 (see FIG. 9F). The magazine 800 can then be pulled from the bottom of the grip 110.

Figure 10:
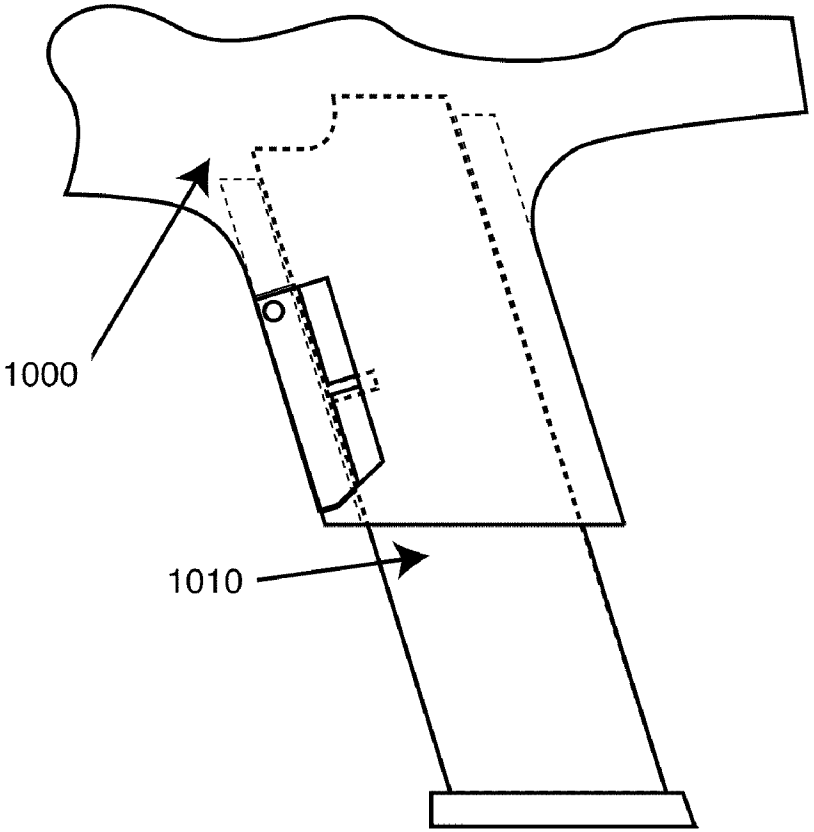
FIG. 10 illustrates another embodiment of a grip.

In one embodiment, the grip can be shorter than a full-size magazine. As illustrated in FIG. 10, the grip 1000 can be shorter than a full-size magazine 1010, thereby accommodating magazines of different length.

Figure 11:
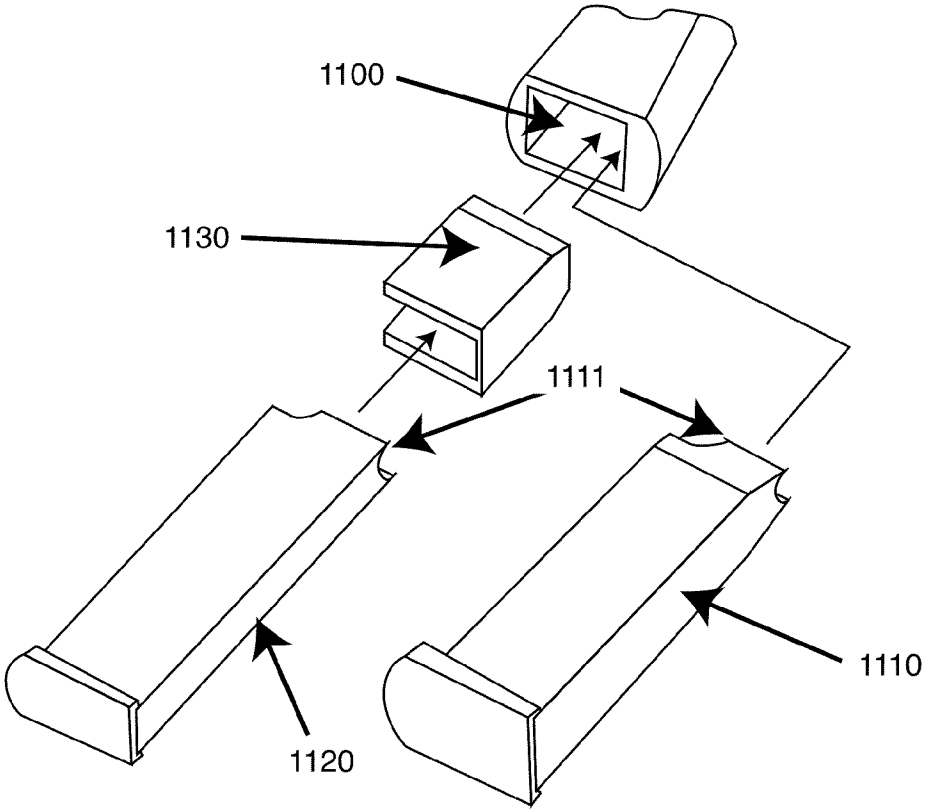
FIG. 11 illustrates an embodiment of an insert for a grip.

In one embodiment, the magazine well in the grip can be larger than the size of the magazine that is inserted into the magazine well. As illustrated in FIG. 11, the magazine well 1100 can be as wide and broad as the largest magazine 1110, with inserts 1130 available to fit smaller or narrower magazines 1120. In one embodiment, the feed lips 1111 of the magazines are located in a specified location, ensuring the proper feeding of the cartridges.

Figure 12:
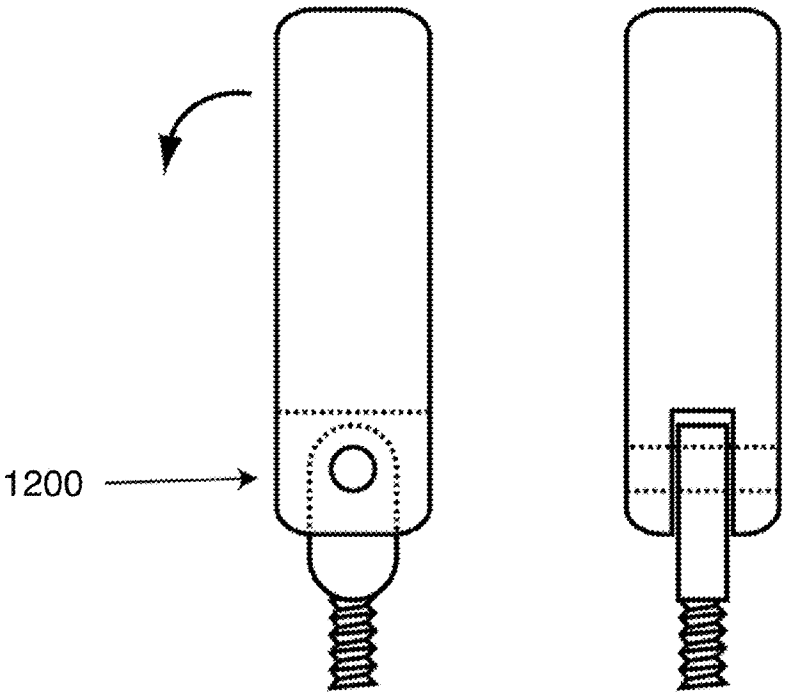
FIG. 12 illustrates another embodiment of a handle.

As illustrated in FIG. 12, in one embodiment the handle can be a folding handle 1200.

Figure 13B:
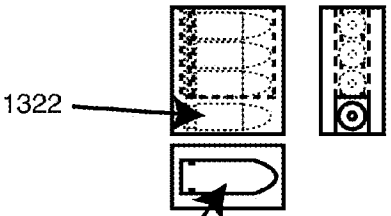
FIGS. 13A-13C illustrate embodiments of loading mechanisms.
Figure 13C:
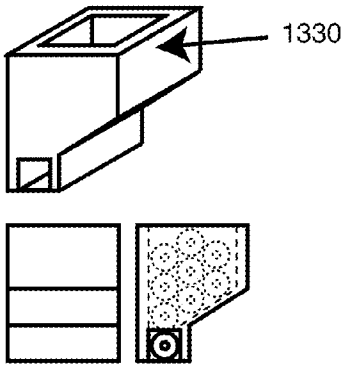
Figure 13A:
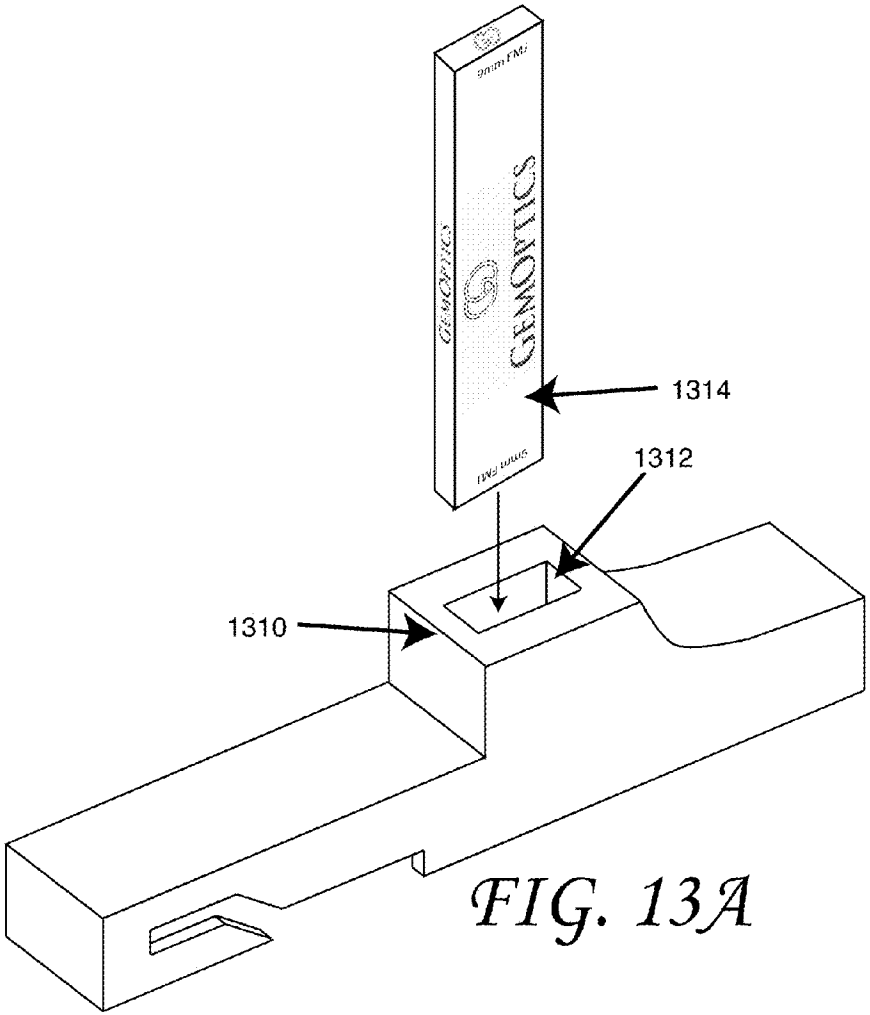
Figure 14:
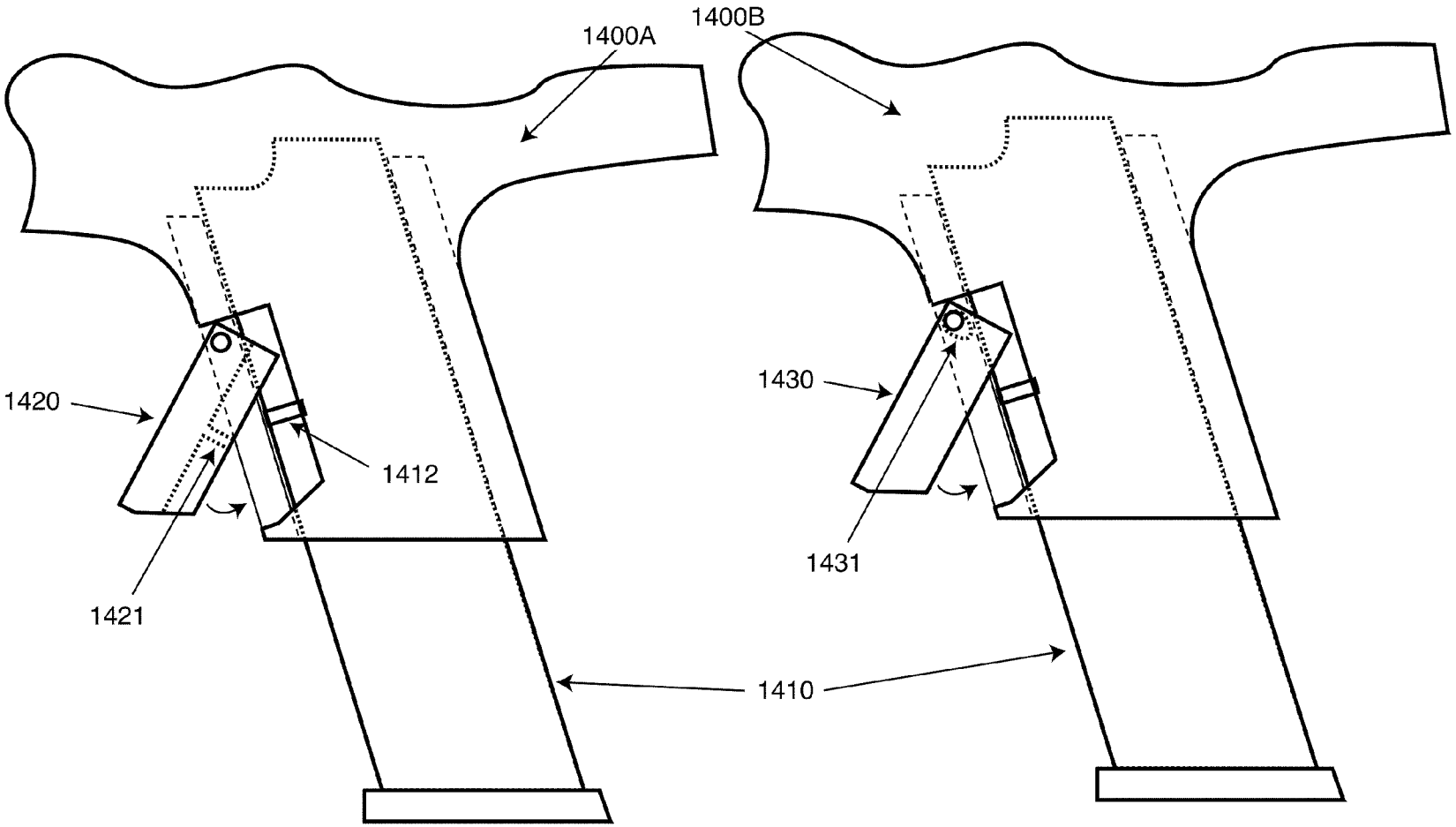
FIG. 14 illustrates another embodiment of a magazine lock.

As illustrated in FIGS. 13A-13C, various feed options are available for loading cartridges into the pistol magazine loader device. FIG. 13A illustrates one embodiment where the cartridge insertion area 1310 includes a well 1312 that is designed to receive a sleeve 1314 of cartridges. FIG. 13B illustrates another embodiment where a keyed chute 1320 is designed to accept a stack of individual cartridges 1322. FIG. 13C illustrates yet another embodiment where a hopper 1330 is configured to accept multiple cartridges.

In various embodiments, the magazine is locked, clamped, or otherwise fixed inside the magazine well in the grip of the pistol magazine loader device. In one embodiment, the rapid pistol magazine loader device 1400A includes a lock 1420 that can have a ridge 1421 that engages the slot 1412 in the magazine 1410 as the lock is rotated in toward the magazine 1410. In another embodiment, the rapid pistol magazine loader device 1400B includes a clamp that would include a rotating handle 1430 with a cammed bar 1431 that would press against the magazine 1410 as the handle 1430 is rotated toward the magazine 1410.

Figure 15A:
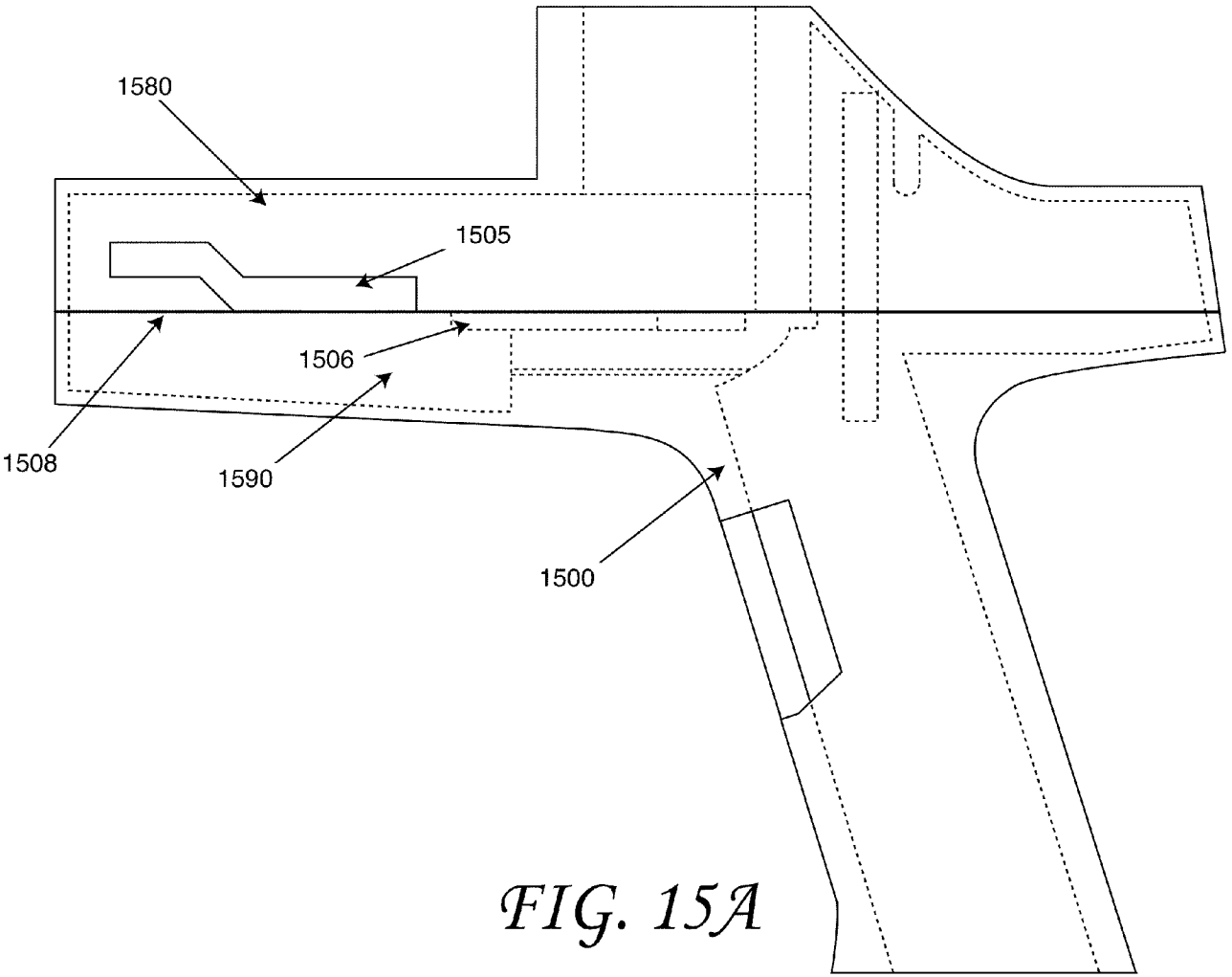
FIGS. 15A-15D illustrate an embodiment of a magazine loading device assembly.
Figure 15B:
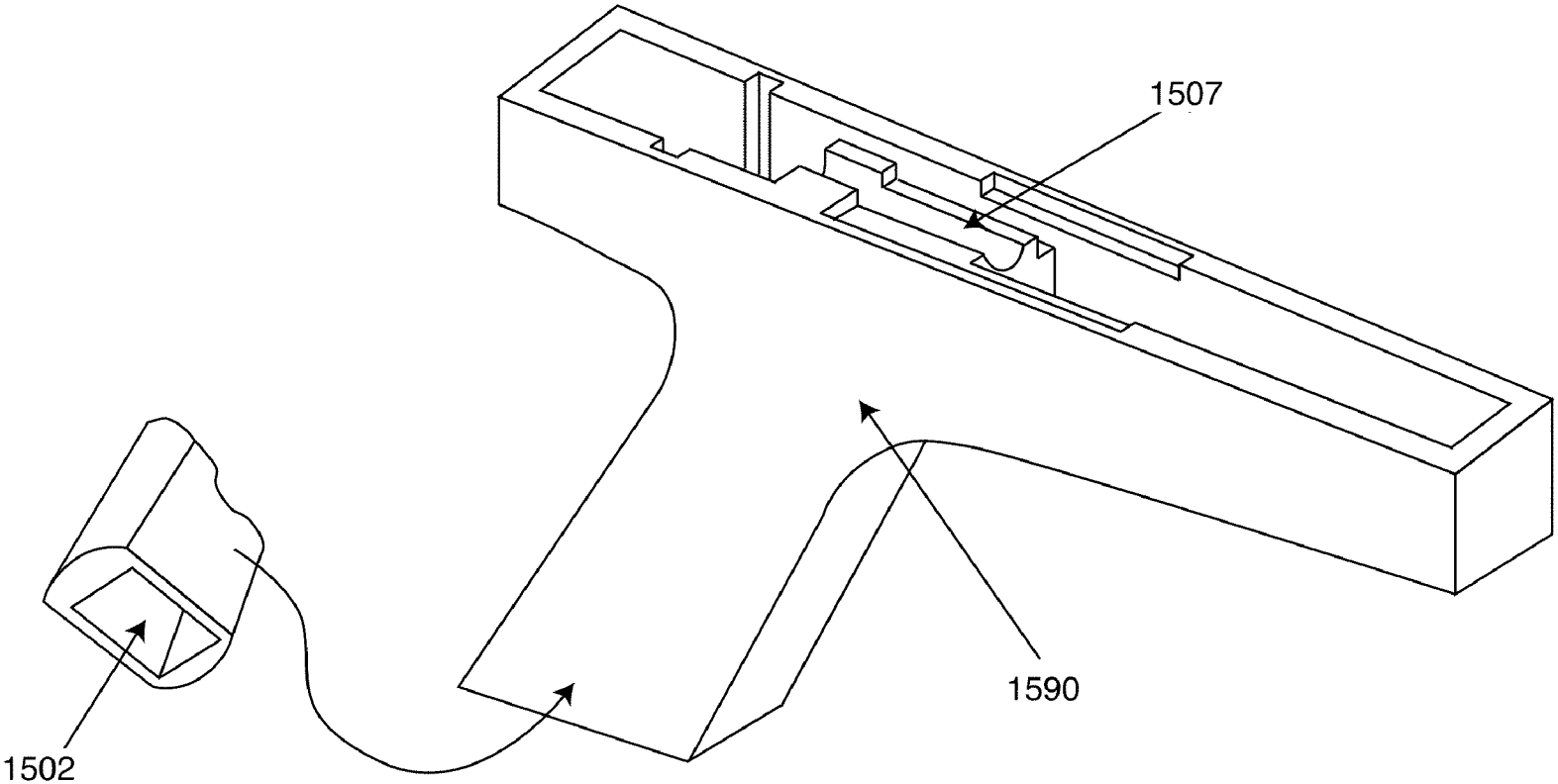
Figure 15C:
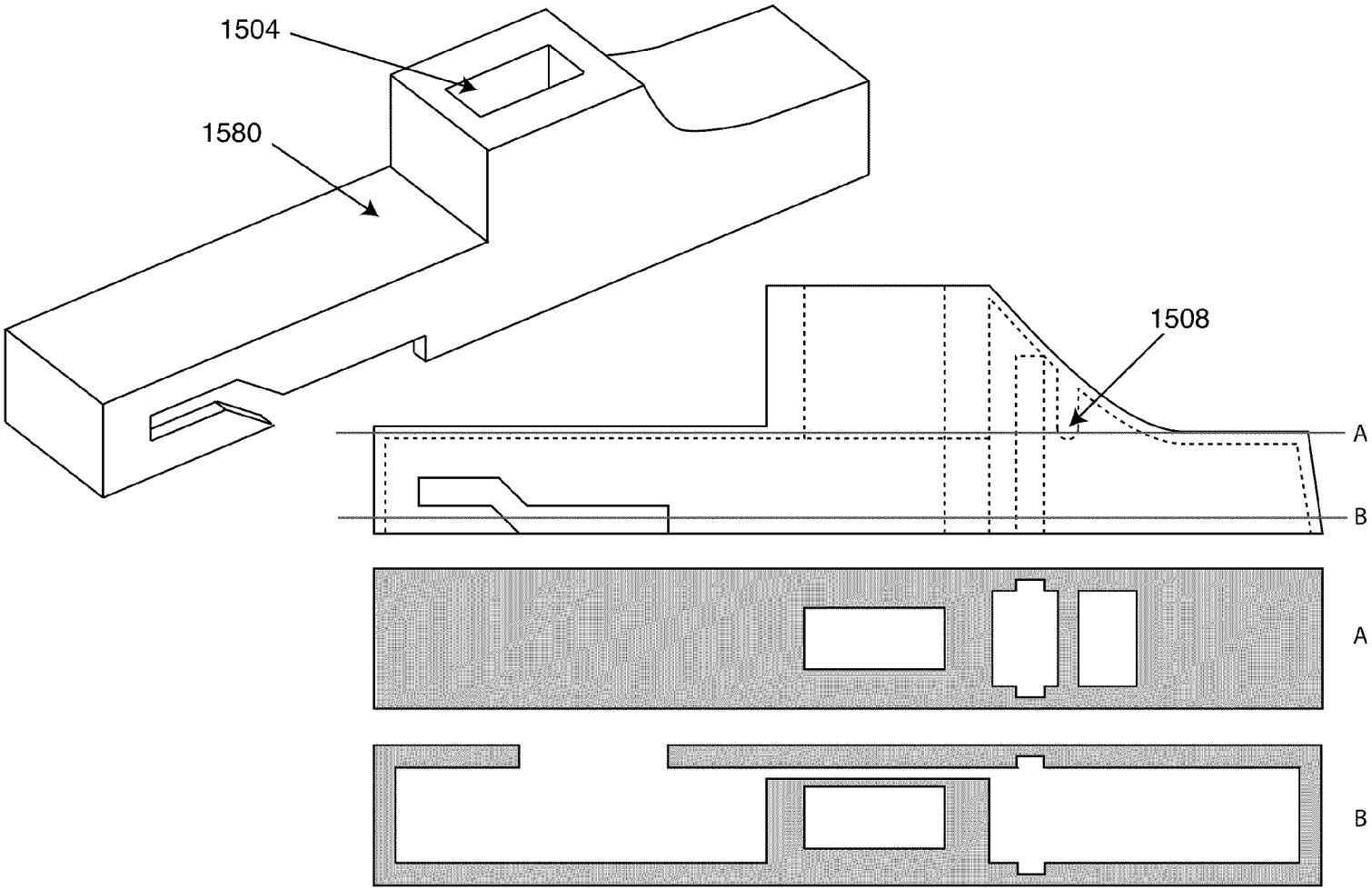
Figure 15D:
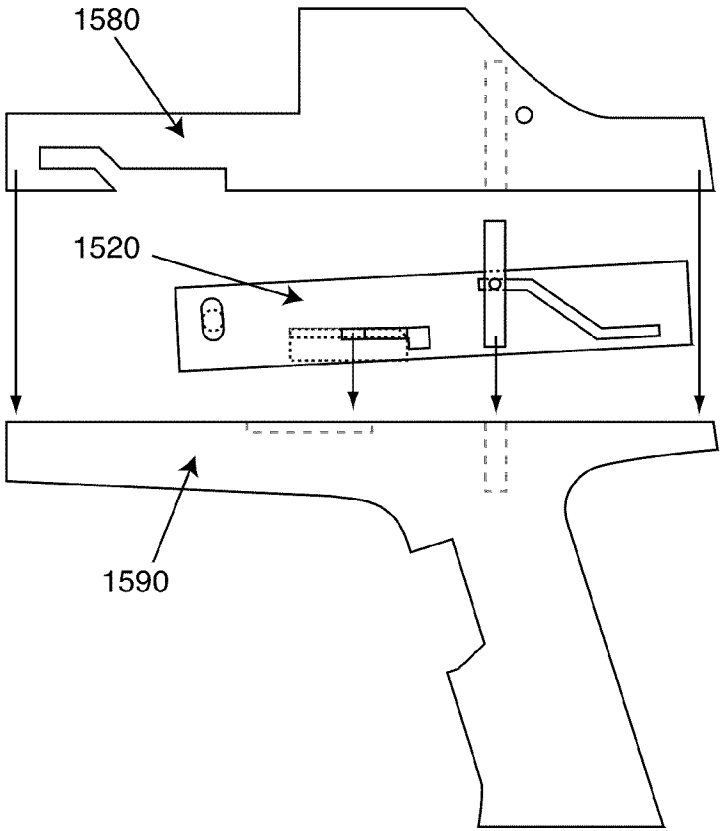

As illustrated in FIG. 15A-15D, for ease of manufacturing, the pistol magazine loader device 1500 can be split into an upper half 1580 and a lower half 1590 along the line defined by the bottom of the handle slot 1505 and the top of the cartridge pusher slots 1506 (see FIG. 15A). The cartridge tray 1507 and the magazine well 1502 are integrated into the lower half 1590 (see FIG. 15B). The cartridge feed 1504 and upper control element limiter 1508 are integrated into the upper half 1580 (see FIG. 15C). FIG. 15C also shows slices in the plane through the upper half defined by A and B. The loader can be assembled by dropping the control element/cartridge pusher/plunger assembly 1520 into the lower half 1590 of the pistol magazine loader device and then fastening the upper half 1580 of the pistol magazine loader device onto the lower half of the pistol magazine loader device (see FIG. 15D).

These and other aspects of the present invention will become apparent to those skilled in the art by a review of the preceding detailed description. Although a number of salient features of the present invention have been described above, the invention is capable of other embodiments and of being practiced and carried out in various ways that would be apparent to one of ordinary skill in the art after reading the disclosed invention, therefore the above description should not be considered to be exclusive of these other embodiments. Also, it is to be understood that the phraseology and terminology employed herein are for the purposes of description and should not be regarded as limiting.

What is claimed is:

1. A pistol magazine loader device, comprising:

a housing designed to receive a magazine;

a plunger designed to push a magazine follower or first cartridge resident at a top of said magazine down into said magazine;

a cartridge pusher configured to push a second cartridge into said magazine in a direction substantially perpendicular to the pushing direction of the plunger; and a control element slidably engaged with said plunger and slidably engaged with said cartridge pusher, said control element coordinating a relative activation of said plunger and said cartridge pusher.

2. The pistol magazine loader device of claim 1, wherein said plunger pushes said first cartridge down into said magazine via contact with a side of said first cartridge.

3. The pistol magazine loader device of claim 1, wherein said plunger pushes said first cartridge down into said magazine via contact with one or more points or areas of said first cartridge.

4. The pistol magazine loader device of claim 3, wherein said plunger pushes said first cartridge down into said magazine via contact with two or more points or areas of said first cartridge.

5. The pistol magazine loader device of claim 1, wherein said cartridge pusher pushes said second cartridge via contact with a tip of said second cartridge.

6. The pistol magazine loader device of claim 1, further comprising a channel formed in a cartridge tray, said channel guiding said second cartridge into said magazine when pushed by said cartridge pusher.

7. The pistol magazine loader device of claim 6, wherein said cartridge pusher is slidably engaged with said channel.

8. The pistol magazine loader device of claim 1, wherein said plunger is slidably engaged with said control element such that a first range of motion of said control element in a predominantly horizontal direction is translated to a corresponding second range of motion of said plunger in a predominantly vertical direction.

9. The pistol magazine loader device of claim 8, wherein said plunger is slidably engaged with a slot formed in said control element.

10. The pistol magazine loader device of claim 9, wherein said slot includes multiple contiguous slot segments, at least one of said multiple contiguous slot segments translating said first range of motion into said second range of motion.

11. The pistol magazine loader device of claim 10, wherein one of said slot segments translates a third range of motion of said control element in a predominantly horizontal direction to a fourth range of motion of said plunger that produces insubstantial change in a position of said magazine follower or said first cartridge.

12. The pistol magazine loader device of claim 1, wherein said cartridge pusher is slidably engaged with said control element via a slot formed in said control element.

13. The pistol magazine loader device of claim 12, wherein said slot delays said cartridge pusher from pushing said second cartridge fully into said magazine until said plunger is disengaged from said magazine follower or said first cartridge.

14. The pistol magazine loader device of claim 13, further comprising a notch formed in said control element at an end of said slot, said notch engaging said cartridge pusher such that a first range of motion of said control element in a predominantly horizontal direction is translated to a corresponding second range of motion of said cartridge pusher in a predominantly horizontal direction, said second range of motion of said cartridge pusher pushing said second cartridge partially into said magazine, wherein said second range of motion ends when said cartridge pusher moves from engagement with said notch to slidable engagement with said slot.

15. The pistol magazine loader device of claim 1, wherein said control element is a planar element.

* * * * *